US010890046B2

(12) United States Patent
Singh et al.

(10) Patent No.: US 10,890,046 B2
(45) Date of Patent: Jan. 12, 2021

(54) MANAGED PRESSURE REVERSE CEMENTING

(71) Applicant: Halliburton Energy Services, Inc., Houston, TX (US)

(72) Inventors: John P. Singh, Kingwood, TX (US); Walmy Cuello Jimenez, Houston, TX (US); Paul Joseph Jones, Houston, TX (US); James Randolph Lovorn, Tomball, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 218 days.

(21) Appl. No.: 16/077,441

(22) PCT Filed: May 11, 2016

(86) PCT No.: PCT/US2016/031766
§ 371 (c)(1),
(2) Date: Aug. 10, 2018

(87) PCT Pub. No.: WO2017/196311
PCT Pub. Date: Nov. 16, 2017

(65) Prior Publication Data

US 2019/0085654 A1 Mar. 21, 2019

(51) Int. Cl.
*E21B 33/14* (2006.01)
*E21B 34/02* (2006.01)
(Continued)

(52) U.S. Cl.
CPC ..... *E21B 33/14* (2013.01); *E21B 17/01* (2013.01); *E21B 33/143* (2013.01);
(Continued)

(58) Field of Classification Search
CPC ..... E21B 33/14
See application file for complete search history.

(56) References Cited

U.S. PATENT DOCUMENTS 3,277,962 A 10/1966 Flickinger et al.
2005/0248334 A1* 11/2005 Dagenais ..... E21B 47/00 324/71.2

(Continued)

FOREIGN PATENT DOCUMENTS

WO WO-00/29715 A1 5/2000
WO WO-2011/119668 A1 9/2011
WO WO-2012/140445 A2 10/2012

OTHER PUBLICATIONS

Schlumberger Oilfield Glossary entry for "equivalent circulating density", accessed May 11, 2020 via www.glossary.oilfield.slb.com. *

(Continued)

*Primary Examiner* — Blake E Michener
(74) *Attorney, Agent, or Firm* — Gilliam IP PLLC

(57) ABSTRACT

Methods and systems including a wellbore having a pipe string extending through a wellhead and into the wellbore, wherein an annulus is formed between the pipe string and the wellbore, an isolation device that closes the wellbore in a closed pressure loop, a choke line in fluid communication with an interior of the pipe string through an outlet port of the wellhead, a choke valve fluidly coupled to the outlet port of the wellhead, wherein the choke valve is manipulable to control fluid flow through the choke line, and a crossover tool in the wellbore to divert incoming fluid from the interior of the pipe string to the annulus.

20 Claims, 2 Drawing Sheets

(51) Int. Cl.

| | |
|---|---|
| ***E21B 47/18*** | (2012.01) |
| ***E21B 47/06*** | (2012.01) |
| ***E21B 17/01*** | (2006.01) |
| ***E21B 34/10*** | (2006.01) |
| *E21B 47/07* | (2012.01) |

(52) U.S. Cl.
CPC ..... *E21B 34/102* (2013.01); *E21B 47/06* (2013.01); *E21B 47/18* (2013.01); *E21B 47/07* (2020.05)

(56) References Cited

U.S. PATENT DOCUMENTS

2007/0261850 A1* 11/2007 Giroux ..... E21B 7/20 166/291
2008/0011482 A1 1/2008 Badalamenti et al.
2013/0118752 A1 5/2013 Hannegan et al.
2014/0116693 A1* 5/2014 Broussard ..... E21B 43/045 166/278
2014/0305662 A1 10/2014 Giroux et al.
2015/0075767 A1* 3/2015 Hammer ..... E21B 43/08 166/51
2015/0267504 A1* 9/2015 Hannegan ..... E21B 19/002 166/340

OTHER PUBLICATIONS

"First UBO in Norway Incorporates Innovative Cement Design, Detailed Operational Planning," Drilling Contractor, Jul./Aug. 2006, 4 pages.
Mashall et al., "Managed Pressure Drilling, Casing and Cementing Enables Success in Conventionally Undrillable Wells in the Harding Field," SPE 166170, Presented Sep. 30-Oct. 2, 2013, 16 pages.
International Search Report and Written Opinion from PCT/US2016/031766, dated May 11, 2016, 15 pages.

* cited by examiner

MANAGED PRESSURE REVERSE CEMENTING

BACKGROUND

The examples herein relate generally to subterranean formation operations and, more particularly, to managed pressure reverse cementing operations in subterranean formations.

In constructing a subterranean well for production of hydrocarbons, a wellbore is drilled into a subterranean formation of interest. Thereafter, a pipe string (e.g., casing, liners, etc.) is often run into the wellbore and cemented in place. The term "pipe string," as used herein, refers to any tubing string used to introduce a fluid or perform a downhole operation, including coiled and jointed tubing string (e.g., to introduce a cement composition). The process of cementing the pipe string in place is commonly referred to as primary cementing, in which a cement composition may be pumped into an annulus between the walls of the wellbore and the exterior surface of the pipe string disposed therein. The cement composition may set in the annular space, thereby forming an annular sheath of hardened, substantially impermeable cement (e.g., a cement sheath). This cement sheath may support and position the pipe string in the well bore, bond the exterior surface of the pipe string to the subterranean formation, prevent communication and migration of fluids between producing zones, and aquifers (and any contamination related thereto), and/or protect the pipe string from corrosion.

Primary cementing may be performed using a reverse cementing method. A reverse cementing method involves displacing a cement composition into the annulus at the surface. As the cement composition is pumped down the annulus, well fluids ahead of the cement composition are displaced down and around the lower end of the pipe string and up the inner diameter of the pipe string and up to the surface. This reverse circulation cementing process is opposite a conventional cementing method, in which the cement composition is pumped through the inner diameter of the pipe string and then upwards into the annulus. Reverse cementing methods may be used to reduce cementing pressure because the cement composition falls down the annulus, thereby producing little or no pressure on the formation. This reduced cementing pressure may cause the pressure in the wellbore to be less than the pressure of the fluid in the subterranean formation. In such instances, formation fluid (e.g., oil, gas, and/or other fluids in a zone of the formation) may influx into the wellbore, which may interfere with cement hydration, among other things.

BRIEF DESCRIPTION OF THE DRAWINGS

The following figures are included to illustrate certain aspects of the examples described herein, and should not be viewed as exclusive examples. The subject matter disclosed is capable of considerable modifications, alterations, combinations, and equivalents in form and function, as will occur to those skilled in the art and having the benefit of this disclosure.

DETAILED DESCRIPTION

Figure 1:
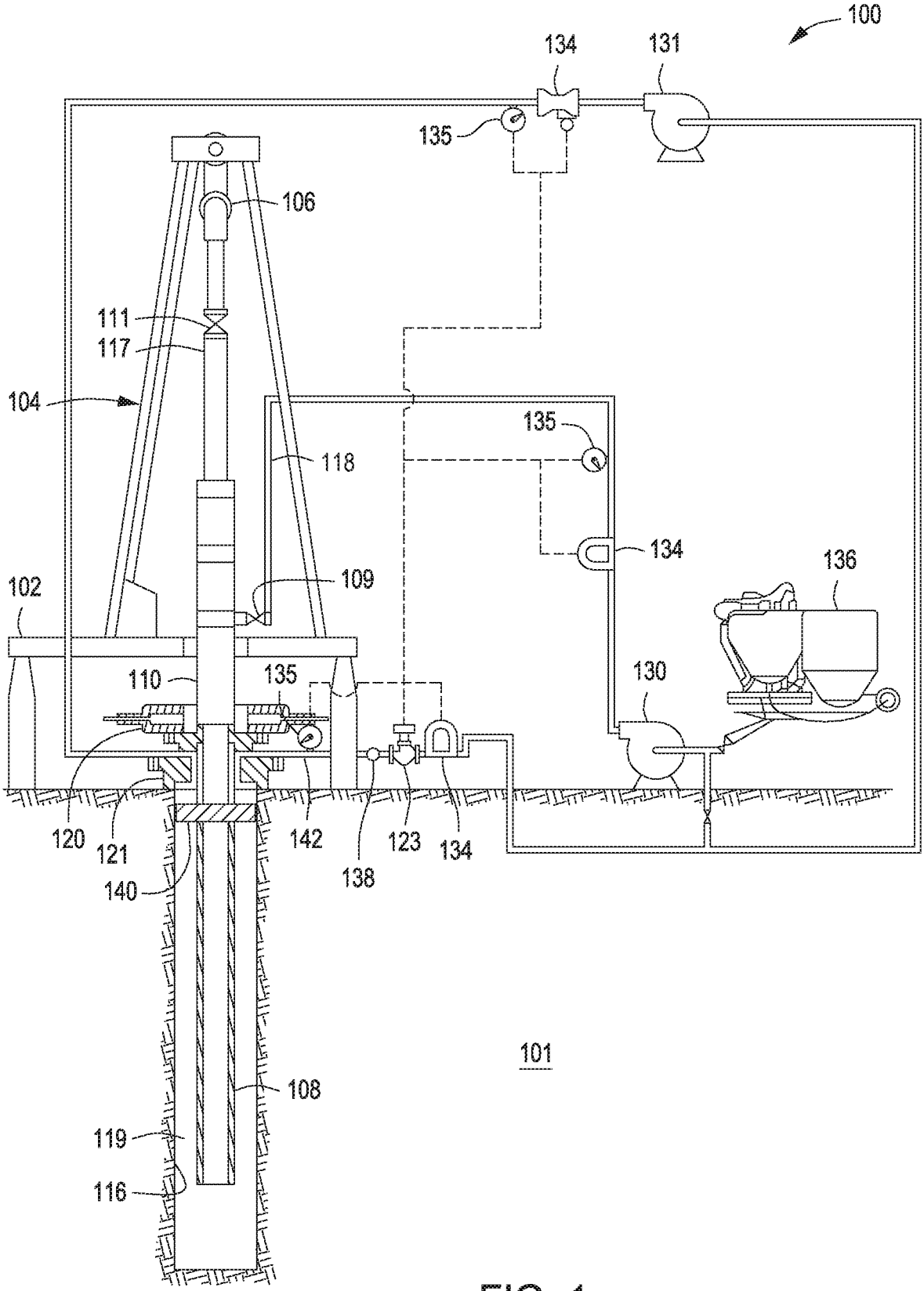
FIG. 1 is a diagram illustrating an onshore wellbore system according to certain examples of the present disclosure.

The examples herein relate generally to subterranean formation operations and, more particularly, to managed pressure reverse cementing operations in subterranean formations.

The present disclosure relates to managed pressure reverse cementing (MPRC) to perform reverse cementing operations under a managed pressure regime. The managed pressure regime is used to control the bottom hole pressure in the wellbore at surface (e.g., to maintain pressure above the pore pressure of the formation) and thus control the influx of formation fluids into the wellbore during a reverse cementing operation. The MPRC uses backpressure and a closed pressure loop in the wellbore to maintain the desired pressure therein, and a choke valve (or simply "choke") to selectively control the flow of fluid out of the wellbore. The choke may additionally provide some control of the flow of fluid into the well by use of the choke (e.g., due to back pressure), which as discussed below, is located at an outlet port at a wellhead. The "closed pressure loop" means that the pressure is continuously monitored or calculated and modified using a feedback loop which operates the choke valve so that desired value of pressure is achieved. The closed pressure loop may be closed by an isolation device, which may include one or more of a rotating control device (RCD), a blow-out preventer (BOP), a packer, or other suitable device for maintaining the closed pressure loop. As described herein, a choke valve located at an outlet port (i.e., in fluid communication with the outlet port) at a wellhead may selectively control the flow of fluid (and/or gas, such as air) out of the wellbore. As used herein, the term "fluid communication" refers to fluid flow between or in contact with two or more components or devices; the term "fluid" refers to liquid and gaseous phase substances. A secondary choke valve may similarly selectively control the flow of fluid (and/or gas) into the wellbore with more precision than the primary choke valve located at the outlet port.

The MPRC process described herein is suitable for use in any wellbore, including offshore and onshore well-bores, and for any type of pipe string therein (e.g., casing string reverse cementing operations, liner reverse cementing operations, and the like). Further, the MPRC process may be utilized in balanced or even underbalanced systems for reverse cementing because of the closed pressure loop, which also may permit a wider range of fluid options for use in performing the reverse cementing operation.

One or more illustrative examples disclosed herein are presented below. Not all features of an actual implementation are described or shown in this application for the sake of clarity. It is understood that in the development of an actual example incorporating the teachings disclosed herein, numerous implementation-specific decisions must be made to achieve the developer's goals, such as compliance with system-related, lithology-related, business-related, government-related, and other constraints, which vary by implementation and from time to time. While a developer's efforts might be complex and time-consuming, such efforts would be, nevertheless, a routine undertaking for those of ordinary skill in the art having benefit of this disclosure.

While compositions and methods are described herein in terms of "comprising" various components or steps, the compositions and methods can also "consist essentially of" or "consist of" the various components and steps. When "comprising" is used in a claim, it is open-ended.

As used herein, the term "substantially" means largely, but not necessarily wholly.

The use of directional terms such as above, below, upper, lower, upward, downward, left, right, uphole, downhole and the like are used in relation to the illustrative examples as they are depicted in the figures herein, the upward direction being toward the top of the corresponding figure and the downward direction being toward the bottom of the corresponding figure, the uphole direction being toward the surface of the well and the downhole direction being toward the toe of the well. Additionally, the examples depicted in the figures herein are not necessarily to scale and certain features are shown in schematic form only or are exaggerated or minimized in scale in the interest of clarity.

The MPRC process described herein employs a choke valve, which may be connected to an outlet port of a wellhead. The choke valve is used to control the outflow of fluids from a wellbore (e.g., from the interior of a pipe string or liner during a reverse cementing operation) through the wellhead via a choke line. In so controlling, the MPRC process allows for enhanced control over equivalent circulation densities (ECD) of fluids in the wellbore (e.g., cement compositions, treatment fluids, and the like) experienced by the formation during primary cementing, particularly for narrow margin applications, combined with reduced surface pressure and reduced times to place a cement composition in the annulus, thereby decreasing operation costs. The choke can be adjusted to control the flow of fluids such that the ECD is maintained between the pore pressure and the fracture gradient. As used herein, the term "pore pressure" means the pressure exerted by fluids within the pores of a formation and the term "fracture gradient" means the pressure required to induce fractures in a formation. The choke described herein further allows primary reverse cementing in high pressure applications (e.g., offshore applications having riser pressure limitations).

In typical reverse cementing operations, fluids, including a cement composition, are placed directly into the annulus between a pipe string and the formation where they are allowed to freefall as they traverse the annulus to reach the bottom of the wellbore. The MPRC process utilizes the choke to advantageously minimize such freefall by controlling outflow, thereby ensuring that the volume of fluid being introduced into the annulus is substantially equivalent to the fluid coming out of the wellbore to the surface. In doing so, an operator can determine the location of various fluids in the wellbore at all times (e.g., where the cement composition is located, where any wellbore fluid is located, and the like). That is, treatment fluids existing in the formation (e.g., for maintaining hydraulic pressure therein) are pushed out of the wellbore through the choke line having the choke valve in fluid communication therewith as a cement composition (or other treatment fluid before the cement composition) is introduced into the wellbore (and into the annulus via the crossover tool). As used herein, the term "treatment fluid" refers to any fluid that may be used in a subterranean application in conjunction with a desired function and/or for a desired purpose. The term "treatment fluid" does not imply any particular action by the fluid or any component thereof. The term "substantially equivalent" with reference to fluids entering and exiting the wellbore using the MPRC process described herein refers to a volume within +/−10% between the volume entering the wellbore and the volume exiting the wellbore.

Accordingly, the operator can use the MPRC process to identify the location of the top of a cement column. With the knowledge of the location of the various wellbore fluids, the primary cementing operation may be optimized to ensure zonal isolation. Additionally, minimizing or eliminating freefall allows any lost circulation that occurs to be detected in real time, thus allowing remedial actions to be taken before significant losses occur. Such losses are detectable because they would be indicated by a discrepancy between the volumetric flow rate of fluid going into the annulus and the return fluid coming from out of the inner diameter of the pipe string. Accordingly, an immediate and predetermined response to the losses could be employed.

The MPRC process described herein may further utilize the choke to generate pressure pulses, which may be used to communicate with various downhole tools (e.g., to activate or deactivate downhole instruments). Advantageously, the pressure pulses created by the choke described herein decrease the time and increase the integrity of the pressure pulse signal by generating the pulse at a choke located at an outlet port of a wellhead. That is, in traditional reverse cementing operations, any applied pressure pulse would have to traverse the annulus and then turn into the interior of a pipe string (or liner) and up to the downhole tool. This results in exposure of the formation to the pressure pulses, which for narrow margin wells may be undesirable, for example, and the pressure pulse can dissipate due to its long travel path. Utilizing a pressure pulse generated at a choke at an outlet port of the wellhead, instead, causes the pressure pulse to travel initially in the interior of the pipe string (or liner) to reach a downhole tool therein without having to traverse the annulus, thereby eliminating exposure of the formation to such pressure pulses and decreasing pressure pulse path length.

The pressure pulse communication can be used alternatively to wired communications, or in combination in some instances. Because the MPRC method employs a closed pressure loop, such wireless pressure pulse communication to downhole tools by means of the choke described herein is possible. That is, in order to effectively propagate a pressure pulse signal using the choke, the closed pressure loop configuration of the MPRC process is necessary. The choke can be used to create negative pressure pulses (e.g., by increasing flow) or positive pressure pulses (e.g., by restricting flow) that can be used to communicate with any downhole tool capable of receiving such pressure pulses. Examples of such downhole tools for receiving the pressure pulse communications described herein may include, but are not limited to, diverter tools, valves, sensors, packers, downhole pressure pulsars, and the like.

In any examples described herein, the MPRC process described herein may employ one or more sensors, such as a pressure sensor and/or a temperature sensor, placed strategically throughout a wellbore, whether the wellbore is an onshore wellbore or an offshore wellbore. Such sensors can be used to monitor, verify, or quantify the performance of the MPRC process. For instance, changes in temperature gradient at a downhole location may be equated to certain types of fluid as a means for determining fluid location throughout the MPRC process. Early or late detection of a fluid, when compared to an expected detection time, can also be used to determine a fluid location based on such sensors. As an example, the sensor(s) may be placed at least at the crossover tool to allow communication across the packer through any means of wireline, telemetry, electromagnetic communication, pressure pulse communication, and the like, and any combination thereof. The crossover tool may be used to divert fluids into the annulus for reverse cementing primary operations, including for both onshore and offshore applications.

The crossover tool may further oppose some restriction to flow, thereby making the crossover tool vulnerable to debris (e.g., drill cuttings) getting packed therein. The MPRC process described herein may be used to selectively and deliberately remove such debris because the MPRC process is able to sense pressure increases due to the increase restrictions in flow because of the presence of the debris. Corrective action may then be immediately taken, or taken at any time thereafter, by applying one or more selective pressure pulses, which may clear the debris from the crossover tool. For the same reasons, the MPRC process can also ensure that the seal at the crossover tool remains resilient by monitoring pressure changes, thereby effectively diverting fluid (e.g., a cementing composition) into the annulus. Moreover, additionally or alternatively, a pressure sensor may be located at the crossover tool to monitor such pressure changes. It is to be appreciated that such pressure pulses can additionally remove any debris (e.g., drill cuttings) that are packed in restrictions in the interior of a pipe string (or liner) due to the presence of downhole tools (e.g., embedded in areas that are restricted from flow due to the downhole tool), without departing from the scope of the present disclosure.

The MPRC process further permits control of surge and swab pressures experienced at loss zones. Additionally, the MPRC process described herein permits pressure and temperature monitoring throughout a wellbore, which can allow verification and/or quantification of hydraulic models. For example, with the use of a casing autofill valve, a diversion sub can be set to allow flow through a liner or casing string during running operations. The increased flow area reduces the hydraulic piston affect while tripping.

Referring now to FIG. 1, illustrated is an exemplary managed pressure system 100 for use in the MPRC system and process described herein. FIG. 1 represents a land based system, but it is to be appreciated that offshore or subsea systems are equally applicable to any of the examples of the present disclosure (e.g., those employing floating or sea-based platforms and rigs), the offshore and onshore systems having similar or identical managed pressure systems for maintaining the closed pressure loop described above. As shown, a wellbore 116 penetrates a portion of a subterranean formation 101. The system 100 may include a platform 102 that supports a derrick 104 having a traveling block 106 for raising and lowering pipe string 108. The pipe string 108 may be a casing string, for example, may be a single pipe string or a jointed pipe string, where the joints are connected together, without departing from the scope of the present disclosure. The pipe string 108 may additionally comprise other equipment for placing the pipe string 108 into the wellbore 116, such as a shoe, a float collar, a centralizer, and the like, and any combination thereof. A casing adapter 110, kelly 111, and spool 117 supports the pipe string 108 as it is lowered through an opening in the floor of the platform 102. Additionally, one or more other pipe strings (not shown) may be concentrically or otherwise disposed and/or cemented into the wellbore 116 uphole of the pipe string 108.

The system 100 further comprises a blowout preventer (BOP) 120 and a variable choke valve 123, which may be connected to the wellbore 116 at wellhead 121. A housing of the BOP 120 may be connected to wellhead 121, such as by a flanged connection, or any other suitable connection. In any or all examples described herein, the BOP housing may also be connected (e.g., by a flanged connection) to a housing of a rotating control device RCD (not shown) into which the casing adapter 110 is inserted. Such RCDs may include a stripper seal for rotation of a pipe string relative to the RCD housing by bearings. Alternatively, the RCD may be omitted from system 100 (or removed from a system used to drill wellbore 116) and a packer or BOP may be used to form a seal with the casing adapter 110 instead. Omission or removal of the RCD may, for example, allow the system 100 to accommodate pressures higher than the maximum pressure for most RCDs known in the art.

The choke valve 123 may be connected to an outlet port 138 of the wellhead 121, where fluids outflow from the wellbore 116 through a choke line 142. The choke valve 123 may include one or more isolation valves that are operable by a controller (not shown) (e.g., an electronic controller, a pneumatic controller, a hydraulic controller, etc.) to maintain backpressure in the wellhead 121 at a particular setpoint determined by an information handling system, as described in further detail below. The choke valve 123 may be used to create the pressure pulses described herein for communication with downhole tools (not shown) in the wellbore 116 and additionally to control ECDs and fluid flow such that the location of various fluids in the wellbore 116 can be determined by an operator, as described above.

The system 100 may further comprise a cement mixer 136 (such as a recirculating mixer) and a cementing pump 130 connected to a cementing manifold 118, which in any or all examples may be a multi-branch manifold, without departing from the scope of the present disclosure. The manifold 118 may include a shutoff valve 109 for providing selective fluid communication between the main line of the manifold 118 and the wellhead 121. The manifold 118 may connect the manifold trunk directly to the casing adapter 110.

The system 100 may additionally comprise a secondary pump 131, one or more flow meters 134 and one or more pressure sensors 135. For example, the pressure sensor 135 connected between the choke valve 123 and the wellhead 121 (or at the choke valve 123) may be operable to monitor wellhead pressure. The pressure sensor 135 connected between the secondary pump 131 and the wellhead 121 and may be operable to monitor a discharge pressure of the secondary pump. The pressure sensor 135 connected between a cement pump 130 and the cementing manifold 118 and may be operable to monitor manifold pressure. The flow meters 134 may each be a mass flow meter, such as a Coriolis flow meter. The cement flow meter 134 connected between the cement pump 130 and the cementing manifold 118 and may be operable to monitor a flow rate of the cement pump. The flow meter 134 connected between the choke valve 123 and the secondary pump 131 and may be operable to monitor a flow rate of return fluid (e.g., return fluid in the interior of the pipe string for a reverse cementing operation or in the annulus uphole of a crossover tool 140 for a reverse cementing operation). The flow meter 134 connected between the secondary pump 131 and the wellhead 121 may be a volumetric flow meter, such as a Venturi flow meter and may be operable to monitor a flow rate of the secondary pump 131.

A crossover tool 140 may be included at a location in the wellbore 116 to divert fluids into the annulus 119. Accordingly, during a reverse cementing operation, a fluid (e.g., a cement composition) is pumped through the cementing manifold 118 and downwardly into the interior of the pipe string 108. Upon reaching the crossover tool 140, the fluid is diverted from the interior of the pipe string 108 and into the annulus 119, where it travels downward to the bottom of the wellbore 116. Fluids that are displaced by the cement composition then travel upward through the interior of the pipe string 108 for removal to the surface either back through the crossover tool 140 or by another means prior to reaching the crossover tool 140. The location of the crossover tool 140 may be at any location within a wellbore (e.g., wellbore 116) below a surface location (either onshore or offshore), without departing from the scope of the present disclosure. In alternate examples, the cement composition may be deposited directly in the annulus without the use of a crossover tool, without departing from the scope of the present disclosure.

Figure 2:
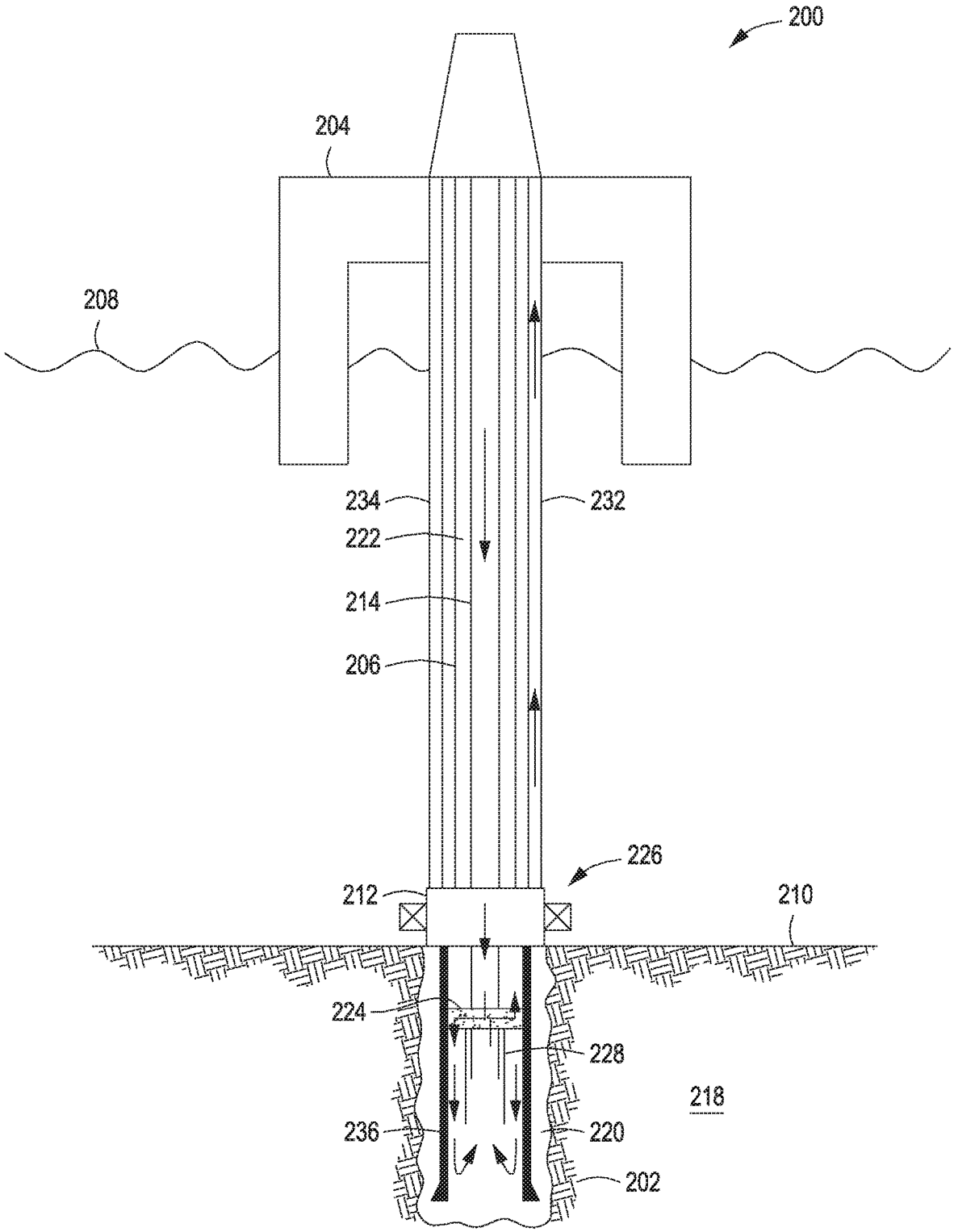
FIG. 2 is a diagram illustrating an offshore wellbore system according to certain examples of the present disclosure.

Referring now to FIG. 2, illustrated is an offshore diagram of a wellbore system 200 according to any or all examples of the present disclosure. The wellbore system 200 is an offshore system, where the portion of the wellbore system 200 at the waterline 208 above the waterline (e.g., on a floating platform or sea-based rig) may be substantially similar or the same as FIG. 1 for achieving the closed pressure loop for performing the MPRC process, including the presence of the choke valve located at an outlet port of a wellhead (e.g., choke valve 123 at outlet port 138 or wellhead 121 of FIG. 1) for achieving the advantages described herein.

A subsea riser 206 extends from a subsea rig 204 at the waterline 208, through the seafloor 210, and is coupled to a subsea wellhead 226 located at the seafloor 210. The riser 206 may be coupled to a subsea BOP 212 in the subsea wellhead 226. As used herein, the term "riser" refers to a hollow pipe that couples the subsea rig 204 (e.g., a subsea drilling rig) to the subsea wellhead 226 and which receives fluid for introduction to a downhole location and for return to above the waterline 208; the riser prevents such fluids from spilling out of the top of the subsea wellhead 226 and onto the seafloor 210. The riser is often large in diameter and acts as a temporary extension of the wellbore 202 to the surface. As used herein, the term "subsea rig" refers to a platform located above the sea surface (e.g., floating, permanent, jackup, and the like) housing machinery and equipment for reverse cementing a wellbore, such as the machinery and equipment described with reference to FIG. 1. A "subsea wellhead" (or simply "wellhead"), as used herein, refers to the seafloor termination of a wellbore that at least incorporates facilities for installing casing hangers during the wellbore cementing phase, and which provides some amount of pressure control.

A choke line 232 and a kill line 234 may addition-ally connect in fluid communication to the subsea BOP 212. The choke line 232 is a high-pressure pipe leading from an outlet on the subsea BOP 212 to a backpressure choke and associated manifold (not shown). The kill line 234 is a high-pressure pipe leading from an outlet on the subsea BOP 212 to high-pressure pumps, such as the subsequent pump 131 of FIG. 1, on the subsea rig 204 at the waterline 208.

As shown, a drill string 214 extends within the riser 206 from the subsea rig 204, through the subsea wellhead 226, and into the well bore 202. A separation 222 between the drill string 214 and the riser 206 may exist, as shown, or may be minimized according to the outer and inner diameters thereof, respectively, without departing from the scope of the present disclosure. The drill string 214 may be a drill string for drilling the wellbore 202 and may serve as a conveyance for delivering a cement composition, for example, in a reverse cementing operation. The drill string 214 extends into the wellbore 202 where it connects in fluid communication with a crossover tool 224. A crossover tool 224 separates the drill string 214 and a pipe string 228 (referred to as liner 228 for offshore systems). As shown, fluid (e.g., a cement composition) travels down the interior diameter of the riser 206 in the drill string 214, past the subsea wellhead 226 (and thus the subsea BOP 212) and into the well bore 202 until it meets the crossover tool 224, which is in fluid communication with both the drill string 214 and the liner 228. The crossover tool 224 diverts the fluid into the annulus 220 of the wellbore 202 (e.g., between one or more casing strings 236 and/or the face of the formation 218 forming the interior of the wellbore 202). The fluid then traverses back up the interior of the liner 228 and is again diverted with the crossover tool 224 into the choke line 232 for removal to the waterline 208.

It is to be appreciated that while FIG. 2 represents a single-gradient offshore system 200, a dual-gradient offshore system may also be employed to perform the MPRC process described herein according to any examples. Dual-gradient offshore systems are used to adjust the density of the column of fluid contained within the wellbore (e.g., a cement composition) by utilizing a two-fluid density to manage pressures of the system and simulate downhole or subsurface operations as though they were being performed at a surface location.

Whether the wellbore system for use in employing the MPRC process described herein is an onshore or offshore system, the reverse cementing operations introduce a cement composition directly downwardly into the annular space within the wellbore, rather than introducing a cement composition through the interior of a pipe string and up through the annular space. In any or all examples, the cement composition may comprise a base fluid and one or more cementitious materials (e.g., Portland cements, fly ash, pozzolanic cements, gypsum cements, high alumina content cements, silica cements, etc.), and one or more other additives used to impart desired properties to the cement (e.g., set retarders, strengthening additives, and the like). Once placed in the annulus, the cement composition is permitted to set therein, thereby forming an annular sheath of hardened, substantially impermeable cement that substantially supports and positions the pipe string (e.g., casing string) and/or liner in the wellbore and bonds the exterior surface thereof to the interior wall of the wellbore, thereby permitting the commencement of subsequent subterranean formation operations (e.g., hydrocarbon production).

One or more pressure sensors may further be included in the MPRC process and systems described herein at a subsurface location. Each of these pressure sensors may be substantially similar to pressure sensors 135 in FIG. 1. The pressure sensors may be located at any position at a subsea location or in a wellbore, including in the annulus of the wellbore, the interior of a pipe string or liner, the subsea BOP, the crossover tool, and the like. The subsurface pressure sensors may be installed on the pipe string 108 (FIG. 1), liner 228 (FIG. 2), or drill string 214 (FIG. 2) or run into the wellbore 116 (FIG. 1) or 202 (FIG. 2) on a wireline or other work string. In a particular example, one or more pressure sensors are located in the crossover tool 140 (FIG. 1) and 224 (FIG. 2), such that the pressure sensor is able to sense the pressure exerted by the flowing fluids therethrough (e.g., a cement composition). In other particular examples, one or more pressure sensors are located in the BOP 120 (FIG. 1) and subsea BOP 212 (FIG. 2), such that the pressure sensor is able to sense the pressure exerted by flowing fluids therethrough (e.g., a cement composition). Combinations of these preferred locations may also be employed in accordance with the examples described herein.

Suitable pressure sensors for use at a subsurface location in accordance with any or all examples described herein may comprise any known pressure sensor in the art including, but not limited, to piezoresistive sensors, piezo-electric sensors, capacitive sensors, fiber optic sensors, and the like, and any combination thereof. In an example, the subsurface pressure sensor may comprise a combination of such devices. For instance, the subsurface pressure sensors may be able to directly monitor the bottomhole pressure in a wellbore. Alternatively, in other examples, the subsurface pressure sensors may additionally include sensors for obtaining non-pressure related measurements as well, including, but not limited to, temperature, fluid density, fluid flow rate, heat capacity, fluid viscosity, and the like, and any combination thereof. These measurements can also be used to calculate pressure. Additional downhole sensors such as pH sensors, temperature sensors, density sensors, heat capacity sensors, conductivity recorders, chemical sensors, radio frequency (RF) sensors, electromagnetic (EM) sensors, acoustic sensors, and the like may be installed in a wellbore in accordance with the MPRC process to directly monitor various conditions and phenomena therein, such as downhole ECDs, as described above. In any or all examples, there could be a plurality of pressure transducers and/or other downhole sensors or measuring devices (not shown) distributed along the length of the well to measure these parameters at different locations.

Referring again to FIG. 1, in any examples of the present disclosure (including those pertaining to offshore wellbore systems), an information handling system may be used to automatically control the choke valve 123 located at the outlet port 138 at the wellhead 121. Such control may be based on a calibrated computer model that can calculate downhole ECDs using measured input data, or based on pressure or other measurements obtained from downhole tools or the subsurface sensors described herein. As an example, the surface pressure may be obtained, a pressure reading located on a downhole tool in the pipe string 108 may be used, and/or a pressure reading from a pressure sensor on the crossover tool 140 as described herein may be obtained. For example, by knowing the physical properties of the wellbore fluids (e.g., a cement composition), in addition to one or more of the pressure measurements and the physical dimensions of the fluid flow path within the wellbore, such a calibrated model can be used to estimate downhole ECDs. That is, physical properties of the wellbore fluids, flow path geometry, real-time data from subsurface sensors (e.g., pressure sensors, temperature sensors, and the like), and any other information gleaned from operations (e.g., flow rate, fluid density, fluid rheology, back pressure, and the like) can be input into the information handling system, which then controls the operation of the choke valve 123 in real-time, thereby enabling the minimization of freefall and controlling the downhole ECDs.

The information handling system may be communicatively coupled to an electronic controller that controls the operation of the choke valve 123. The information handling systems of the present disclosure may be configured to receive and process data from sensors in the wellbore system (e.g., a subsurface pressure sensor) and other data sources (e.g., flowmeters 134) to perform a number of functions. For example, the information handling system may use such data to monitor whether ECDs or other conditions in the wellbore are at (or within acceptable variances of) a setpoint, select or calculate a setpoint for the choke valve 123 and/or ECDs for a reverse cementing operation, incorporate that data into a computational model for a downhole operation, and/or other related functions. The information handling systems of the present disclosure may be further configured to send electrical signals to one or more electronic controllers coupled to various pieces of equipment in a well bore operation system (e.g., choke valves, BOPs, RCDs, pumps, etc.) to automate their operation.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer or tablet device, a cellular telephone, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more devices for reading storage media, one or more network ports for communication with external devices as well as various input and output (I/O) devices, such as a keyboard, a mouse, and a video display. The information handling system may also include one or more buses operable to transmit communications between the various hardware components. It is to be appreciated that the information handling system may be communicatively coupled to the components through wired or wireless connections to facilitate data transmission to or from other components of the system. The information handling system used in the examples of the present disclosure may be located at the well site or, alternatively, may be provided at a remote location. When the information handling system is remotely located, it may communicate with the electronic controller for the choke system and/or the downhole pressure sensor (as well as any other optional sensors in the system) via an external communications interface installed at the well site. The external communications interface may be connected to and permit an information handling system at a remote location communicatively coupled to the external communications interface via, for example, a satellite, a modem or wireless connections to send signals to and/or receive signals from one or more components at the well site. In any or all examples, the external communications interface may include a router.

Any suitable processing application software package may be used by the information handling to process the data from the subsurface pressure sensor and/or other surface or optional subsurface sensors in the system. In one example, the software produces data that may be presented to the operation personnel in a variety of visual display presentations such as a display. In a certain example system, the measured data or conditions of the choke valve 123 may be displayed to allow the user to manually identify, characterize, or locate a downhole condition (e.g., location of fluid). The data may be presented to the user in a graphical format (e.g., a chart) or in a textual format (e.g., a table of values). In another example system, the display may show warnings or other information to the operator when the central monitoring system detects a downhole condition. Suitable information handling systems and software packages may include those used in the iCem® service or the GeoBalance® Managed Pressure Drilling service provided by Halliburton Energy Services, Inc. The software package may be provided to an information handling system via programming into the hardware of that system, via computer-readable media, or a combination thereof.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

The terms "couple" or "couples," as used herein are intended to mean either an indirect or a direct connection. Thus, if a first device couples to a second device, that connection may be through a direct connection, or through an indirect electrical connection via other devices and connections. The term "communicatively coupled" as used herein is intended to mean coupling of components in a way to permit communication of information therebetween. Two components may be communicatively coupled through a wired or wireless communication network, including but not limited to Ethernet, LAN, fiber optics, radio, microwaves, satellite, and the like.

While various examples have been shown and described herein, modifications may be made by one skilled in the art without departing from the scope of the present disclosure. The examples described here are exemplary only, and are not intended to be limiting. Many variations, combinations, and modifications of the examples disclosed herein are possible and are within the scope of the disclosure. Accordingly, the scope of protection is not limited by the description set out above, but is defined by the claims which follow, that scope including all equivalents of the subject matter of the claims.

Examples disclosed herein include:

Example A

A method comprising: providing a pipe string extending through a wellhead and into the wellbore, wherein an annulus is formed between the pipe string and the wellbore; an isolation device that closes the wellbore in a closed pressure loop; a choke line in fluid communication with an interior of the pipe string through an outlet port of the wellhead; a choke valve fluidly coupled to the outlet port of the wellhead, wherein the choke valve is manipulable to control fluid flow through the choke line; and a crossover tool in the wellbore to divert incoming fluid from the interior of the pipe string to the annulus; introducing a cement composition into the wellbore, wherein the crossover tool diverts the cement composition from the interior of the pipe string to the annulus; receiving a treatment fluid through the choke valve; manipulating fluid flow through the choke valve so that an equivalent circulating density of the cement composition and an equivalent circulating density of the treatment fluid are both between a pore pressure of the subterranean formation and a fracture gradient of the subterranean formation; and setting the cement composition in the annulus.

Example B

A method comprising: providing a pipe string extending through a wellhead and into the wellbore, wherein an annulus is formed between the pipe string and the wellbore; an isolation device that closes the wellbore in a closed pressure loop; a choke line in fluid communication with an interior of the pipe string through an outlet port of the wellhead; a choke valve fluidly coupled to the outlet port of the wellhead, wherein the choke valve is manipulable to control fluid flow through the choke line; and a crossover tool in the wellbore to divert incoming fluid from the interior of the pipe string to the annulus; introducing a cement composition into the wellbore, wherein the crossover tool divers the cement composition from the interior of the pipe string to the annulus; receiving a treatment fluid through the choke valve; manipulating fluid flow through the choke valve so that the volume of the cement composition introduced into the wellbore is substantially equivalent to the volume of the treatment fluid received through the choke valve; and setting the cement composition in the annulus.

Example C

A system comprising: a pipe string extending through a wellhead and into a wellbore in a subterranean formation, wherein an annulus is formed between the pipe string and the wellbore; an isolation device that closes the wellbore in a closed pressure loop; a choke line in fluid communication with an interior of the pipe string through an outlet port of the wellhead; a choke valve fluidly coupled to the outlet port of the wellhead, wherein the choke valve is manipulable to control fluid flow through the choke line; and a crossover tool in the wellbore to divert incoming fluid from the interior of the pipe string to the annulus, wherein the system is used for performing a reverse cementing operation.

Each of Examples A, B and C may have one or more of the following additional elements in any combination:

Element 1: Wherein the wellbore further comprises a subsurface pressure sensor.

Element 2: Wherein the wellbore further comprises a subsurface pressure sensor in fluid communication with the crossover tool.

Element 3: Wherein the wellbore further comprises a subsurface pressure sensor, and further comprising communicating pressure data from the subsurface pressure sensor to an information handling system.

Element 4: Further comprising manipulating the fluid flow through the choke valve using a controller and an information handling system.

Element 5: Wherein the wellbore further comprises a downhole tool, and further comprising manipulating the fluid flow through the choke valve to create a pressure pulse for communication with the downhole tool.

Element 6: Wherein the pipe string is casing string or a liner.

Element 7: Wherein the wellbore is an onshore wellbore or an offshore wellbore.

Element 8: Wherein the system or method is an onshore system or method, or an offshore system or method.

Element 9: Wherein the system or method is a single-gradient offshore system or method.

Element 10: Wherein the system or method is a dual-gradient offshore system or method.

By way of non-limiting example, exemplary combinations applicable to A, B and/or C include: 1-9; 1-8 and 10; 1, 4, and 8; 2 and 6; 1, 3, 5, and 6; 2 and 4; 8 and 9; 5, 6, and 8; 4 and 10; and the like.

Therefore, the examples disclosed herein are well adapted to attain the ends and advantages mentioned as well as those that are inherent therein. The particular examples disclosed above are illustrative only, as they may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative examples disclosed above may be altered, combined, or modified and all such variations are considered within the scope and spirit of the present disclosure. The examples illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

What is claimed is:

1. A method comprising:

providing a pipe string extending through a wellhead and into a wellbore, wherein an annulus is formed between the pipe string and the wellbore;

closing, with an isolation device, the wellbore in a closed pressure loop;

introducing a cement composition for a reverse cementing process to an interior of the pipe string;

diverting, with a crossover tool, the cement composition from the interior of the pipe string to the annulus;

measuring, with a pressure sensor, pressure of the interior of the pipe string at the crossover tool; and based at least partly on the measured pressure of the interior of the pipe string at the crossover tool, manipulating fluid flow through an outlet port of the wellhead using a choke valve to maintain an equivalent circulating density of fluids in the wellbore between a pore pressure of a subterranean formation into which the wellbore is formed and a fracture gradient of the subterranean formation.

2. The method of claim 1, further comprising manipulating fluid flow through the choke valve to create a pressure pulse for communication with a downhole tool.

3. The method of claim 1, further comprising:

measuring, with a first flow meter, a flow rate of the cement composition entering the wellbore;

measuring, with a second flow meter, a flow rate of a fluid exiting the wellbore; and manipulating the choke valve until the flow rate of the cement composition entering the wellbore is equal to the flow rate of the fluid exiting the wellbore.

4. The method of claim 3, further comprising:

determining a first volumetric flow rate based, at least partly, on the measured flow rate of the cement composition entering the wellbore;

determining a second volumetric flow rate based, at least partly, on the measured flow rate of the fluid exiting the wellbore; and detecting a loss in circulation based on a discrepancy between the first volumetric flow rate and the second volumetric flow rate.

5. The method of claim 1, further comprising calculating the equivalent circulating density based, at least partly, on the measured pressure of the interior of the pipe string at the crossover tool.

6. The method of claim 5, further comprising:

determining whether the calculated equivalent circulating density is between the pore pressure and the fracture gradient; and manipulating fluid flow through the choke valve based, at least in part, on the determination of whether the calculated equivalent circulating density is between the pore pressure and the fracture gradient.

7. The method of claim 1, further comprising identifying a location of a top of a column of the cement composition based, at least partly, on the measured pressure.

8. The method of claim 1, further comprising regulating, with the choke valve, a volume of cement composition entering the annulus to be substantially equivalent to a volume of a fluid exiting the wellbore to minimize freefall of the cement composition during the reverse cementing process.

9. The method of claim 1, further comprising:

monitoring a change in pressure in the interior of the pipe string at the crossover tool; and determining whether a seal at the crossover tool is compromised based, at least partly, on the change in pressure in the interior of the pipe string at the crossover tool.

10. A method comprising:

providing a pipe string extending through a wellhead and into a wellbore, wherein an annulus is formed between the pipe string and the wellbore;

closing, with an isolation device, the wellbore in a closed pressure loop;

introducing a fluid to an interior of the pipe string as part of a reverse cementing operation;

diverting, with a crossover tool, incoming fluid from the interior of the pipe string to the annulus;

measuring a pressure of the interior of the pipe string at the crossover tool during the reverse cementing operation;

detecting a restriction in fluid flow at the crossover tool based, at least partly, on the measured pressure; and based at least partly on the measured pressure of the interior of the pipe string at the crossover tool, manipulating fluid flow through an outlet port of the wellhead using a choke valve to generate a pressure pulse at the choke that travels, initially, in the interior of the pipe string.

11. The method of claim 10, wherein the pressure pulse is for communication with a downhole tool.

12. The method of claim 10, further comprising:

determining that the restriction in fluid flow at the crossover tool is caused, at least partly, by a build up of debris at the crossover tool based, at least partly, on the measured pressure; and clearing the build up of debris at the crossover tool by manipulating the fluid flow through the choke valve to create a pressure pulse.

13. The method of claim 10, further comprising generating a negative pressure pulse by manipulating the choke valve to increase fluid flow through the outlet port of the wellhead.

14. The method of claim 10, further comprising generating a positive pressure pulse by manipulating the choke valve to restrict fluid flow through the outlet port of the wellhead.

15. The method of claim 10, further comprising calculating an equivalent circulating density based, at least partly, on the measured pressure of the interior of the pipe string at the crossover tool.

16. The method of claim 15, further comprising:

determining whether the calculated equivalent circulating density is between a pore pressure and a fracture gradient of a subterranean formation; and manipulating the fluid flow through the choke valve based, at least in part, on the determination of whether the calculated equivalent circulating density is between a pore pressure of the subterranean formation and a fracture gradient of the subterranean formation.

17. A system comprising:

a pipe string extending through a wellhead and into a wellbore, wherein an annulus is formed between the pipe string and the wellbore;

an isolation device that closes the wellbore in a closed pressure loop;

a crossover tool in the wellbore to divert a fluid from an interior of the pipe string to the annulus;

a pressure sensor placed at the crossover tool and within the interior of the pipe string; and a choke valve fluidly coupled to an outlet port of the wellhead, wherein the choke valve is manipulable to control an equivalent circulating density of the fluid in the wellbore.

18. The system of claim 17, further comprising a first flow meter to measure a flow rate of a fluid entering the wellbore.

19. The system of claim 18, further comprising a second flow meter to measure a flow rate of a fluid exiting the wellbore.

20. The system of claim 17, further comprising a downhole tool.

* * * * *